US007128321B1

(12) United States Patent
Brown

(10) Patent No.: US 7,128,321 B1
(45) Date of Patent: Oct. 31, 2006

(54) INSTANT FEEDBACK WEAPONS QUALIFICATION TARGET

(76) Inventor: Jeffrey Brown, 2316 Territorial Rd., St. Paul, MN (US) 55114

( * ) Notice: Subject to any disclaimer, the term of this patent is extended or adjusted under 35 U.S.C. 154(b) by 0 days.

(21) Appl. No.: 11/255,108

(22) Filed: Oct. 21, 2005

(51) Int. Cl.
*F41J 5/14* (2006.01)

(52) U.S. Cl. ..... 273/392

(58) Field of Classification Search ..... 273/385–393
See application file for complete search history.

(56) References Cited

U.S. PATENT DOCUMENTS 687,873 A * 12/1901 Daniels ..... 273/390
1,435,768 A * 11/1922 Wang ..... 273/392
1,569,781 A * 1/1926 Orr ..... 273/392
1,640,954 A * 8/1927 Mach ..... 273/369
1,865,988 A * 7/1932 Wiedeck ..... 273/385
2,113,719 A * 4/1938 Creswell ..... 273/390
2,777,695 A * 1/1957 Cohn ..... 273/386
2,957,694 A * 10/1960 Barber et al. ..... 273/388
3,506,266 A * 4/1970 Wintersteen ..... 273/392
4,373,733 A * 2/1983 Smith, Jr. ..... 273/381
4,917,388 A * 4/1990 Marquardt ..... 273/392
5,257,790 A * 11/1993 Meadows ..... 273/389

* cited by examiner

*Primary Examiner*—Mark S. Graham
(74) *Attorney, Agent, or Firm*—Thomas B. Tate

(57) ABSTRACT

A weapons qualification target that provides instant feedback to the shooter as to whether he or she hit the standard scoring pattern. The target has a metal plate that moves backward and upward on a pivot point when the shot is within the standard scoring pattern, and then moves forward and downward to reset for the next shot.

2 Claims, 1 Drawing Sheet

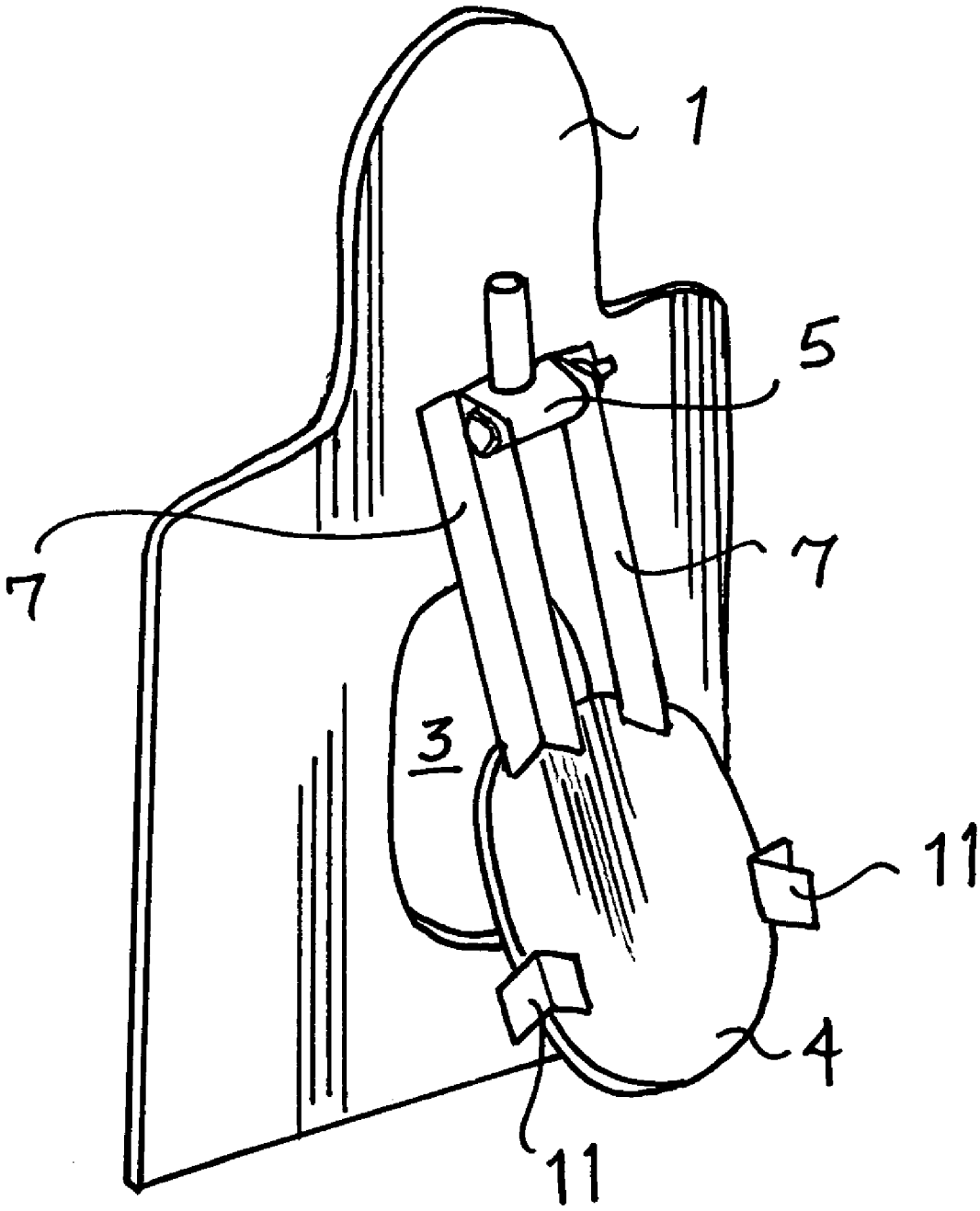
1
5
7
7
3
11
4
11

INSTANT FEEDBACK WEAPONS QUALIFICATION TARGET

BACKGROUND OF THE INVENTION

The field of the invention is targets, specifically targets used for weapons qualification.

Federal, state, and local law enforcement agencies require their personnel to undergo weapons qualification testing as part of their initial training and periodically thereafter to maintain their skills. Targets having a standard scoring pattern (different agencies use different patterns) are used for this purpose. Traditionally the targets are paper targets. The shooter checks the target at the end of his or her shooting period, and a new target is set up for the next shooter.

No weapons qualification targets that provide instant feedback and have a standard scoring pattern are currently on the market. The closest known prior art is described in U.S. Pat. No. 4,373,733 to Smith, Jr., which shows a target having a human shape that reacts to being hit by a bullet. Smith, Jr.'s target slides on a rail and is pulled forward by elastic, and does not have a standard scoring silhouette.

SUMMARY OF THE INVENTION

The invention is a weapons qualification target that has a metal plate that corresponds to the standard scoring pattern and moves backward and upward on a pivot point when hit by a bullet, and then automatically pivots back to its original position.

An advantage of the invention is that the shooter knows instantly whether he or she hit the scoring pattern. This is not only faster but also safer because the shooter does not have to cross the firing line to visually inspect the target up close.

Another advantage is that the target is made of metal rather than paper, and thus can be reused, which saves the agency money.

Another advantage is that the target resets itself for each shooter.

DESCRIPTION OF THE DRAWINGS

The FIGURE is a back perspective view.

DETAILED DESCRIPTION OF THE INVENTION

The target is made entirely of metal, preferably steel. The main portion 1 is shaped like a human silhouette. A small hole (not shown) is provided through the main portion 1, through which a conventional stand (not shown) can be bolted to allow the target to stand upright. A larger opening 3, corresponding to a standard scoring pattern, is formed through the main portion 1. The oval opening 3 shown is but one of many standardized scoring patterns that exist, and is shown by way of illustration and not by way of limitation, as any standardized scoring pattern can be used.

A plate 4 is aligned with opening 3. The plate 4 is slightly smaller than opening 3 and is the same shape as opening 3. A hinge-like pivot point 5 is welded onto the back side of the main portion 1. A pair of legs 7 are welded onto the pivot point 5 and extend vertically to the back side of the plate 4, to which they are also welded. A pair of tabs 11 are welded onto opposite sides of the back side of plate 4 and extend horizontally beyond the edges of opening 3.

When a shooter shoots into the standard scoring pattern of opening 3, the bullet strikes the plate 4 and causes the plate 4 to move backward and upward on the pivot point 5 (the attached legs 7 and tabs 11 moving with the plate 4), thus indicating a score. The plate 4 then pivots forward and downward (the pivot point 5 swinging by gravity) until the tabs 11 strike the back side of the main portion 1, preventing the plate 4 from passing through the opening 3. Thus the target is reset for the next shot.

I claim:

1. A weapons qualification target that provides instant feedback to a shooter, said target comprising:

a silhouette-shaped main portion;

an opening formed into said main portion, said opening having the shape of a standard weapons qualification scoring pattern;

a plate having the same shape as said opening, said plate being slightly smaller than said opening and being aligned with said opening;

a pivot point attached to the back side of said main portion;

a pair of vertical legs attached to a pivot point and to said plate;

a pair of tabs attached to said plate, each tab extending beyond an edge of said plate, said tabs being positioned opposite each other;

wherein said target provides instant feedback to a shooter as to whether he or she shot within said scoring pattern, using the following means: when said shooter shoots into said opening corresponding to said scoring pattern and the shot hits said plate, said plate moves backward and upward from said pivot point to indicate a score, then resets for the next shot by swinging forward and downward into alignment with said opening corresponding to said scoring pattern, said tabs striking the back side of said main portion to prevent said plate from swinging beyond said opening.

2. The target of claim 1 wherein said main portion, said plate, said pivot point, said legs, and said tabs are made of steel.

* * * * *